US005361125A

United States Patent [19]

Fletcher

[11] Patent Number: 5,361,125

[45] Date of Patent: Nov. 1, 1994

[54] INTERMEDIATE TRANSFER MEMBER

[75] Inventor: Gerald M. Fletcher, Pittsford, N.Y.

[73] Assignee: Xerox Corporation, Stamford, Conn.

[21] Appl. No.: 805,743

[22] Filed: Dec. 12, 1991

[51] Int. Cl.[5] ..... G03G 15/14

[52] U.S. Cl. ..... 355/271; 355/273

[58] Field of Search ..... 355/219, 221, 272, 275, 355/273, 274, 271, 200, 210, 211

[56] References Cited

U.S. PATENT DOCUMENTS

| | | | |
|---|---|---|---|
| 3,784,300 | 1/1974 | Hudson et al. | 355/273 |
| 4,014,605 | 3/1977 | Fletcher | 355/273 |
| 4,190,348 | 2/1980 | Friday | 355/274 |
| 4,341,455 | 7/1982 | Fedder | 355/274 |
| 4,348,098 | 9/1982 | Koizumi | 355/274 |
| 4,684,238 | 8/1987 | Till et al. | 355/275 |
| 5,119,140 | 6/1992 | Berkes et al. | 355/271 X |
| 5,132,743 | 7/1992 | Bujese et al. | 355/274 |
| 5,159,392 | 10/1992 | Kasahara et al. | 355/275 X |
| 5,189,479 | 2/1993 | Matsuda et al. | 355/274 |

*Primary Examiner*—Matthew S. Smith
*Assistant Examiner*—Shuk Y. Lee
*Attorney, Agent, or Firm*—Denis A. Robitaille

[57] ABSTRACT

An apparatus for enabling a conductive backed photoconductive intermediate transfer member in an electrophotographic printing apparatus with pre-charge and light assist. The printing apparatus includes a toner transfer system having an intermediate transfer belt comprising a highly conductive transparent substrate with a charging device and an illumination lamp. The intermediate transfer belt is pre-charged prior to entering a transfer nip region to generate low or reverse fields therein. Subsequently, the photoconductive layer of the intermediate surface is exposed to light energy to discharge the pre-charge thereon, generating high transfer fields in the transfer nip.

17 Claims, 3 Drawing Sheets

INTERMEDIATE TRANSFER MEMBER

The present invention relates generally to a system for transfer of charged toner particles in an electrostatographic printing apparatus, and more particularly concerns an apparatus for enabling a conductive backed photoconductive intermediate transfer member with pre-charge and light assist.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing material is subsequently deposited onto the photoreceptive member such that the developing material is attracted to the charged image areas on the photoconductive surface thereof to develop the electrostatic latent image into a visible image. The developing material is then transferred from the photoreceptive member, either directly or after an intermediate transfer step to a copy sheet or other support substrate to create an image which may be permanently affixed to the copy sheet, providing a reproduction of the original document. In a final step, the photoconductive surface of the photoreceptive member is cleaned to remove any residual developing material thereon in preparation for successive imaging cycles.

The described electrostatographic copying process is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The process of transferring developing material from an image support surface to a second supporting surface is realized at a transfer station. In a conventional transfer station, transfer is achieved by applying electrostatic force fields in a transfer region sufficient to overcome forces which hold the toner particles to the photoconductive surface on the photoreceptive member. These electrostatic force fields operate to attract and transfer the toner particles over onto the second supporting surface which may be an intermediate transfer belt or an output copy sheet. An intermediate transfer belt is desirable for use in tandem color or one pass paper duplex applications where successive toner powder images are transferred onto a single copy sheet. These systems may also utilize multiple photoconductive drums in lieu of a single photoconductive drum.

Historically, transfer of toner images between support surfaces in electrostatographic applications is often accomplished via electrostatic induction using a corotron or other corona generating device. In corona induced transfer systems, the second supporting surface, an intermediate support member or a copy sheet is placed in direct contact with the toner image while the image is supported on the image bearing surface (typically a photoconductive surface). Transfer is induced by spraying the back of the second supporting surface with a corona discharge having a polarity opposite that of the toner particles, thereby electrostatically transferring the toner particles to the second supporting surface. An exemplary corotron ion emission transfer system is disclosed in U.S. Pat. No. 2,807,233. Alternatively, transfer can be induced by applying a potential difference between the substrate of a biased member contacting the second supporting member and the substrate of the image bearing surface that originally supports the toner image layer.

The critical aspect of the transfer process focuses on applying and maintaining high intensity electrostatic fields in order to overcome the adhesive forces acting on the toner particles to thus induce the physical detachment and transfer-over of the charged particulate toner materials from one surface to a second supporting surface-without scattering or smearing of the developer material. This difficult requirement is met by careful control of the electrostatic fields across the transfer region so that the fields are high enough to effect toner transfer while being low enough so as not to cause arcing-excessive corona generation, or excessive transfer of toner in the regions prior to intimate contact of the second supporting surface and the toner image. Imprecise and inadvertent electrostatic fields can create copy or print defects by inhibiting toner transfer or by inducing uncontrollable toner transfer, causing scattering or smearing of the development materials.

The problems associated with successful image transfer are well known. Variations in ambient environment conditions, second supporting surface resistivity, contaminants, and changes in the toner charge or in the adhesive properties of the toner materials, can all effect necessary transfer parameters. Material resistivity and toner properties can change greatly with humidity and other environmental parameters. In the pre-transfer or so called pre-nip region, immediately in advance of second supporting surface contact with the image, excessively high transfer fields can result in premature transfer across the air gap, leading to decreased resolution or blurred images. High transfer fields in the pre-nip air gap can also cause ionization which may lead to strobing or other image defects, loss of transfer efficiency, and a lower latitude of system operating parameters. Conversely, in the post-transfer or so called post-nip region, at the photoconductor/second supporting surface separation area, insufficient transfer fields can cause image dropout and may generate hollow characters. Also, improper ionization in the post-nip region may cause image stability defects or can create copy sheet detacking problems. Inducing variations in desirable field strength across the transfer region must be balanced against the basic premise that the transfer field should be as large as possible in the region directly adjacent the transfer nip where the second supporting surface contacts the image so that high transfer efficiency and stable transfer can be achieved.

Various approaches and solutions to the problems inherent to the transfer process and specifically related to systems including an intermediate transfer member have been proposed. The following disclosures may be relevant to various aspects of the present invention:

U.S. Pat. No. 3,784,300 Patentee: Hudson et al. Issued: Jan. 8, 1974

U.S. Pat. No. 4,014,605 Patentee: Fletcher Issued: Mar. 29, 1977

U.S.Pat. No. 4,684,238 Patentee: Till et al. Issued: Aug. 4, 1987

The relevant portions of the foregoing disclosures may be briefly summarized as follows:

U.S. Pat. No. 3,784,300 discloses a xerographic imaging system including a pre-transfer station having a pre-transfer corotron and lamp arranged such that the electrical potentials associated with a latent image on a xerographic plate are altered without adversely affecting the operation of pre-transfer treatment.

U.S. Pat. No. 4,014,605 discloses an electrostatographic copying system wherein a toner image is transferred from an original image support surface to a copy surface by an electrically biased transfer member generating a transfer field, the transfer field is tailored by providing a photoconductive layer in the transfer area, which layer is illuminated, to render it conductive, in the nip and post-nip areas, but not in the pre-nip area. Belt transfer systems are disclosed utilizing this arrangement.

U.S. Pat. No. 4,684,238 discloses an intermediate transfer apparatus in which a plurality of liquid images are transferred from a photoconductive member to a copy sheet. The liquid images, which include a liquid carrier having toner particles dispersed therein, are attracted from the photoconductive member to an intermediate belt and the toner particles are compacted thereon in image configuration. Thereafter, the toner particles are transferred from the intermediate belt to the copy sheet in image configuration.

In accordance with the present invention, an apparatus for transferring toner from an image support surface to a substrate is provided, wherein an intermediate transfer member is positioned to have at least a portion thereof adjacent the image support surface to define a transfer zone including a pre-transfer zone, a transfer nip, and a post-transfer zone and means, located adjacent said pre-transfer zone, are provided for establishing a pre-charge on the intermediate transfer member in the pre-transfer zone while means, located adjacent the transfer zone, are provided for dissipating the pre-charge on the intermediate transfer member. The apparatus may include a conductive substrate having a photoconductive layer wherein the dissipating means includes an illumination source.

In another aspect of the invention, an electrostatographic printing apparatus is disclosed, comprising a transfer assembly for transferring toner from an image support surface to a copy substrate wherein the transfer apparatus includes an intermediate transfer member positioned to have at least a portion thereof adjacent the image support substrate to define a pre-transfer zone, a transfer zone, and a post-transfer zone and means, located adjacent said pre-transfer zone, are provided for establishing a pre-charge on the intermediate transfer member in the pre-transfer zone thereof, while means, located adjacent the transfer zone, are provided for dissipating the pre-charge on the photoconductive layer of said intermediate transfer member.

In yet another aspect of the invention, an apparatus for transferring charged toner particles from an image support surface to a sheet is disclosed, comprising an intermediate transfer member being adapted to receive toner particles from the image support surface and to transfer the toner particles therefrom to the sheet, wherein the intermediate transfer member includes a conductive substrate having a photoconductive layer deposited thereon.

These and other aspects of the present invention will become apparent from the following description in conjunction with the accompanying drawings, in which.

Figure 1:
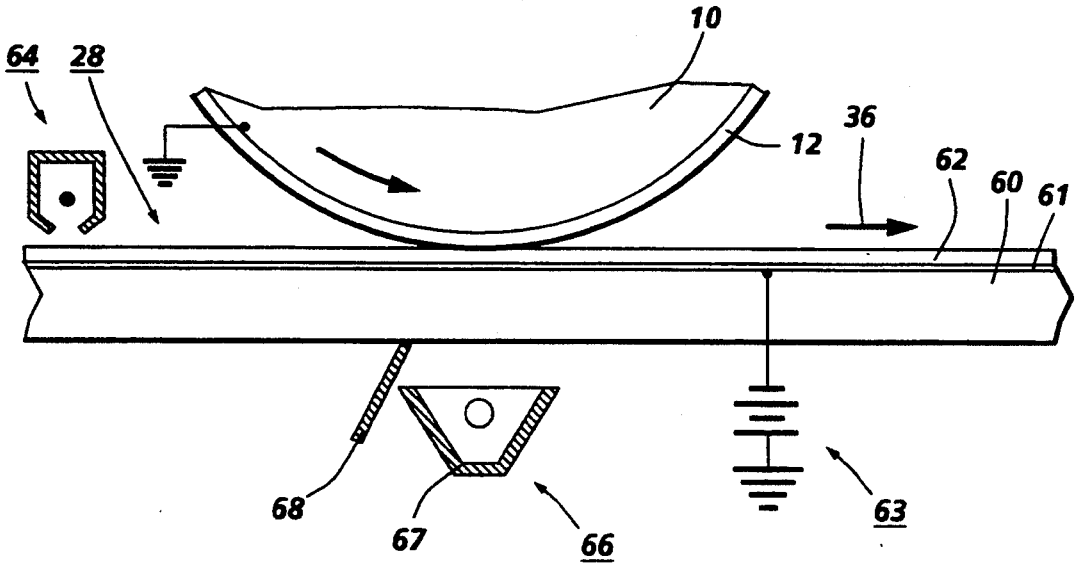
FIG. 1 is an enlarged schematic side view of a preferred embodiment of the transfer assembly of the present invention showing a pre-transfer charging device and a nip illumination source.

While the present invention will be described with reference to a preferred embodiment thereof, it will be understood that the invention is not to be limited to this preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout to designate identical elements.

Figure 5:
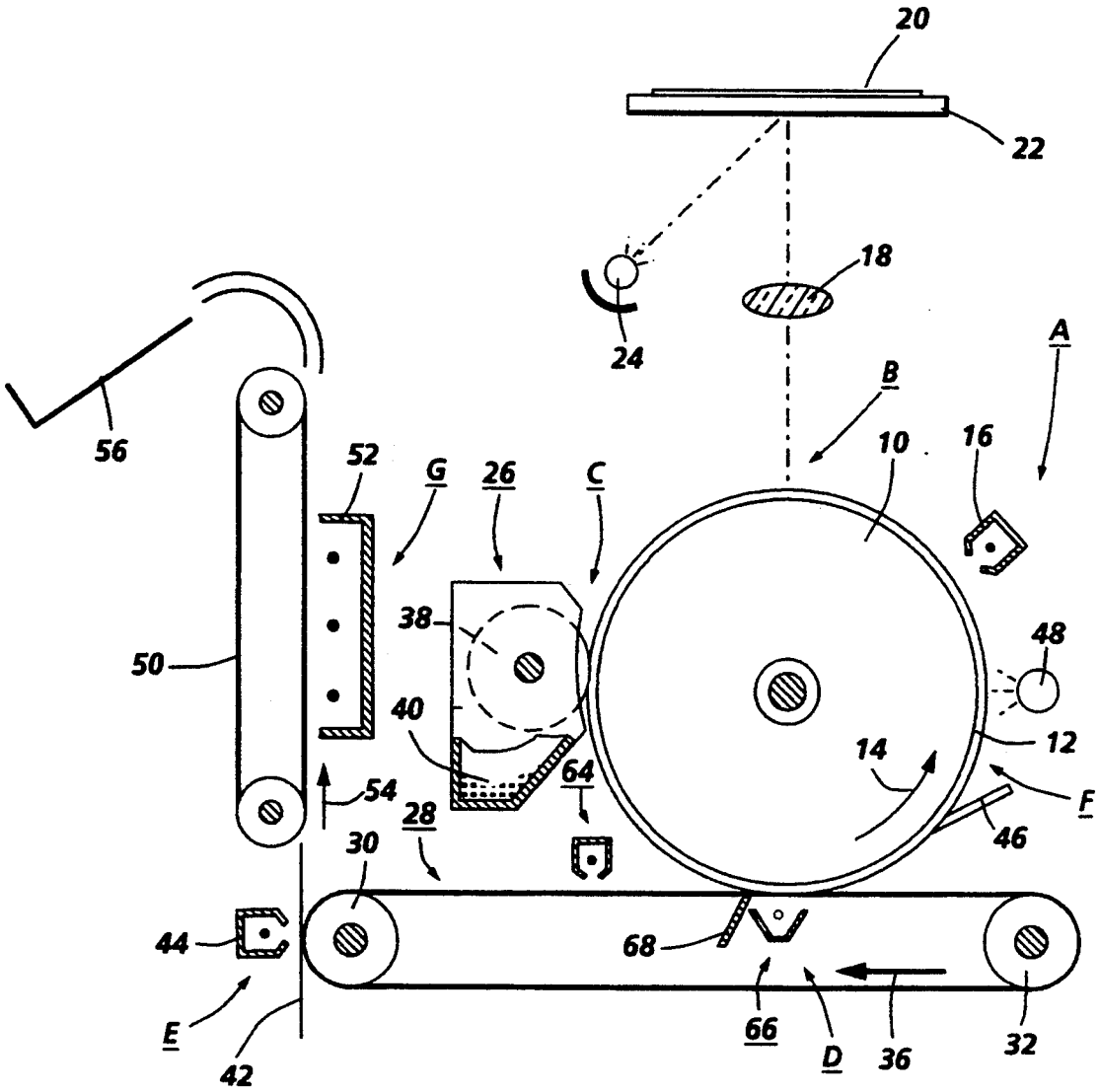
FIG. 5 is a schematic elevational view illustrating an exemplary electrostatographic printing machine incorporating the features of the present invention.

For a general understanding of an electrostatographic printing machine in which the features of the present invention may be incorporated, reference is made to FIG. 5, which schematically depicts the various components thereof. It will become apparent from the following discussion that the transfer assembly of the present invention is equally well-suited for use in a wide variety of electroreprographic machines, as well as a variety printing, duplicating and facsimile devices.

Moving initially to FIG. 5, before describing the specific features of the present invention, the electrophotographic copying apparatus employs a drum 10 having a photoconductive layer 12 deposited on an electrically grounded conductive substrate. The photoconductive layer 12 provides a surface mounted on the exterior circumferential surface of drum 10 and entrained thereabout. A series of processing stations are positioned about drum 10 such that as drum 10 rotates in the direction of arrow 14, it transports the photoconductive surface sequentially therethrough. Drum 10 is driven at a predetermined speed relative to the other machine operating mechanisms by a drive motor. Timing detectors (not shown) sense the rotation of drum 10 and communicate with machine logic to synchronize the various operations thereof so that the proper sequence of events is produced at the respective processing stations.

Initially, drum 10 rotates the photoconductive layer 12 through charging station A. At charging station A, a corona generating device, indicated generally by the reference numeral 16, sprays ions onto photoconductive surface 12 producing a relatively high substantially uniform charge thereon.

Once charged, the photoconductive layer 12 is rotated on drum 10 to exposure station B where a light image of an original document is projected onto the charged portion of the photoconductive surface. Exposure station B includes a moving lens system, generally designated by the reference numeral 18. An original document 20 is positioned face down upon a generally planar, substantially transparent platen 22. Lamps 24 are adapted to move in timed coordination with lens 18 to incrementally scan successive portions of original document 20. In this manner, a scanned light image of original document 20 is projected onto the photoconductive surface of photoconductive layer 12. This process selectively dissipates the charge on the photoconductive layer 12 to record an electrostatic latent image corresponding to the informational areas in original document 20 onto the photoconductive surface of photoconductive layer 12. While the preceding description relates to a light lens system, one skilled in the art will appreciate that other devices, such as a modulated laser beam may be employed to selectively discharge the charged portion of the photoconductive surface to record the electrostatic latent image thereon.

After exposure, drum 10 rotates the electrostatic latent image recorded on the surface of photoconductive layer 12 to development station C. Development station C includes a developer unit, generally indicated by the reference numeral 26, comprising a magnetic brush development system for depositing developing material onto the electrostatic latent image. Magnetic brush development system 26 includes a single developer roller 38 disposed in developer housing 40. In the developer housing 40, toner particles are mixed with carrier beads, generating an electrostatic charge therebetween, causing the toner particles to cling to the carrier beads and form developing material. Developer roller 38 rotates and attracts the developing material, forming a magnetic brush having carrier beads and toner particles magnetically attached thereto. Subsequently, as the magnetic brush rotates, the developing material is brought into contact with the photoconductive surface 12, the electrostatic latent image thereon attracts the charged toner particles of the developing material, and the latent image on photoconductive surface 12 is developed into a visible image.

At transfer station D, the developed toner image is electrostatically transferred to an intermediate member or belt indicated generally by the reference numeral 28. Belt 28 is entrained about spaced rollers 30 and 32, respectively. Belt 28 moves in the direction of arrow 36. Further details of the transfer system will be described hereinafter.

As belt 28 advances in the direction of arrow 36, the toner image transferred thereto advances to transfer station E where copy sheet 42 is advanced, in synchronism with the toner particle image on belt 28, for transfer of the image to output on output copy sheet. Transfer station E includes a corona generating device 44 which sprays ions onto the backside of copy sheet 42 to attract the toner particles from belt 28 to copy sheet 42 in image configuration.

After the toner particles are transferred to copy sheet 42, the copy sheet advances on conveyor 50 through fusing station G. Fusing station G includes a radiant heater 52 for radiating sufficient energy onto the copy sheet to permanently fuse the toner particles thereto in image configuration. Conveyor belt 50 advances the copy sheet 42, in the direction of arrow 54, through radiant fuser 52 to catch tray 56 where the copy sheet 42 may be readily removed by a machine operator.

Invariably, some residual carrier beads and toner particles remain adhered to photoconductive surface 12 of drum 10 after transfer of the image to belt 28. These residual particles and carrier beads are removed from photoconductive surface 12 at cleaning station F. Cleaning station F includes a flexible, resilient blade 46, having a free end portion placed in contact with photoconductive layer 12 to remove any material adhering thereto. Thereafter, lamp 48 is energized to discharge any residual charge on photoconductive surface 12 in preparation for a successive imaging cycle.

The foregoing description should be sufficient for the purposes of the present application for patent to illustrate the general operation of an electrophotographic copying apparatus incorporating the features of the present invention. As described, an electrophotographic copying apparatus may take the form of any of several well known devices or systems. Variations of specific electrostatographic processing subsystems or processes may be expected without affecting the operation of the present invention.

Referring now specifically to FIG. 1, the transfer station of the present invention and the particular structure thereof will be discussed in detail. FIG. 1 illustrates an enlarged detailed view in a cross-sectional plane extending along the direction of motion of the photoconductive drum 10 and perpendicular to the intermediate transfer belt 28. A conventional transfer nip is formed at the point of contact between the photoconductive imaging surface of the photoconductive layer 12 of xerographic drum 10 and the intermediate transfer belt 28. The intermediate transfer belt travels through the nip, moving into and out of engagement with the imaging surface of drum 10 where the toner powder image thereon is transferred to the intermediate transfer belt 28. The curvature of the imaging surface of the drum 10 relative to the intermediate transfer belt 12 defines a transfer zone including a transfer nip as well as a pre-transfer nip air gap and a post-transfer nip air gap along the upstream and downstream sides, respectively, of the transfer nip.

The intermediate transfer belt 28 comprises a photoconductive layer 62 supported on a conductive backing substrate 60 having a conductive plane 61 therebetween. An illuminating lamp 66 as well as a pre-nip charging device 64, which may include a conventional corona generating device, are also provided in the transfer region, as shown in FIG. 1.

In a conventional system, electrostatic image transfer from the xerographic drum 10 to the intermediate transfer belt is typically accomplished by applying an electrical transfer field at the transfer nip located at the point of contact between photoconductive surface 12 and the intermediate transfer belt 28. The electrical transfer field is typically generated by a conventional corona generating device or a bias transfer roll, as is well known in the art. However, in the present invention, electrostatic image transfer to the intermediate transfer belt 28 is accomplished via bias source 63 coupled to conductive plane 61, providing an applied potential difference between the conductive substrate 62 of the intermediate belt 28 and the conductive substrate of the photoconductor drum 10. Alternatively, or in addition, a bias potential can be applied to drum 10 to provide the applied potential difference, as appropriate. Transfer is further enhanced via a light assist through the use of an illumination source 66, and through the use of a pre-nip charging device 64, as will be described in greater detail herein. It will be appreciated by those of skill in the art that, although the present discussion refers to a "photoconductor drum" as the toner image bearing member, a photoconductor belt might also act as the image bearing member in this invention.

As previously stated, the intermediate transfer belt 28 of the present invention comprises an at least partially transparent or light transmissive conductive substrate 60 coated with a photoconductive layer 62. Electrostatic image transfer to the intermediate transfer belt 28 is accomplished by generating an appropriate pre-charge on the photoconductive surface 62 of the intermediate transfer belt 28 for creating relatively low transfer fields (or possibly even reversal fields) in the pre-transfer gap immediately upstream from the transfer nip. The pre-charge generates surplus surface potential on the intermediate which has a cumulative effect on the transfer fields that is similar to the applied potential difference between the conductive substrate 60 and the drum 10. After application of the pre-charge, the photoconductive surface 62 is illuminated via illumination source 66 to substantially collapse the internal field in the photoconductive layer 62 of intermediate belt 28, thereby effectively discharging the pre-charge on the intermediate transfer belt 28 to cause an increase in the transfer field. Thus, desirable high transfer fields are generated in the transfer nip area while undesirable electrostatic fields in the pre-transfer nip area are reduced or eliminated. Pre-charging in the pre-transfer nip area can be accomplished with any conventional corona generating device such as a corotron, scorotron, bias member, etc.

It may be seen from FIG. 1, that illumination source 66, which may include a conventional lamp or other light source, is partially surrounded by a light shield 67 and a light baffle 68. In this manner, the radiant energy from the illumination source 66 can be directed into a selected area across the photoconductive surface 62 of the intermediate transfer belt 28, through the light transmissive conductive substrate 60. The illumination source 66 continuously illuminates the same area of the transfer region, namely the transfer nip, while the shield 67 and baffle 68 prevent the radiant energy generated by illumination source 66 from exposing other areas of the photoconductive layer 62 which might render the photoconductive surface 62 conductive, thereby preventing the dissipation of the charge thereon in the pre-nip-region.

The inventive intermediate transfer belt structure 28 of the present invention, including a photoconductive surface 62 and a transparent highly conductive substrate 60, in combination with a pre-nip charging device 64 and illumination source 66 accomplishes the objective of rendering very high transfer fields in the transfer nip while minimizing or eliminating the transfer fields in the pre-nip region. A pre-charge polarity commensurate with the charge on the toner to be transferred to the intermediate transfer belt 28 is required. For example, a positively charged photoconductive surface 12 requires a positive pre-charge as well as a positively charged toner. Thus, by applying a pre-charge in the pre-nip area corresponding to the charge on the toner, the transfer field intensity in the transfer pre-nip is forced to a relatively weak level which is incapable of prematurely transferring toner from the imaging surface 12. By contrast, illumination of the photoconductive surface 62 of the intermediate transfer belt 28 within the transfer nip renders the intermediate transfer belt 28 "conductive" so that transfer charges are conducted in the nip region adjacent the interface between the intermediate transfer belt 28 and the photoconductive surface 12 of the drum 10. It will be understood that the term "conductive", as used in this discussion, means that the electrostatic field across the photoconductive intermediate is substantially collapsed to a low value by the light.

Since the photoconductive layer 62 of intermediate transfer belt 28 is not an imaging surface and is subjected only to flooding illumination rather than precise imaging, an imaging quality photoconductive material is not necessary. Thus, inexpensive and relatively optically insensitive (low efficiency) photoconductive materials can be utilized for the intermediate transfer belt of the present invention. For example, various known photoconductor web materials may be used in which organic or inorganic photoconductive particles are held by an organic translucent binder material providing the desired physical properties for the belt. It will be appreciated, however, that the thickness and dielectric constant of the intermediate transfer belt 28 should be substantially uniform.

Figure 2:
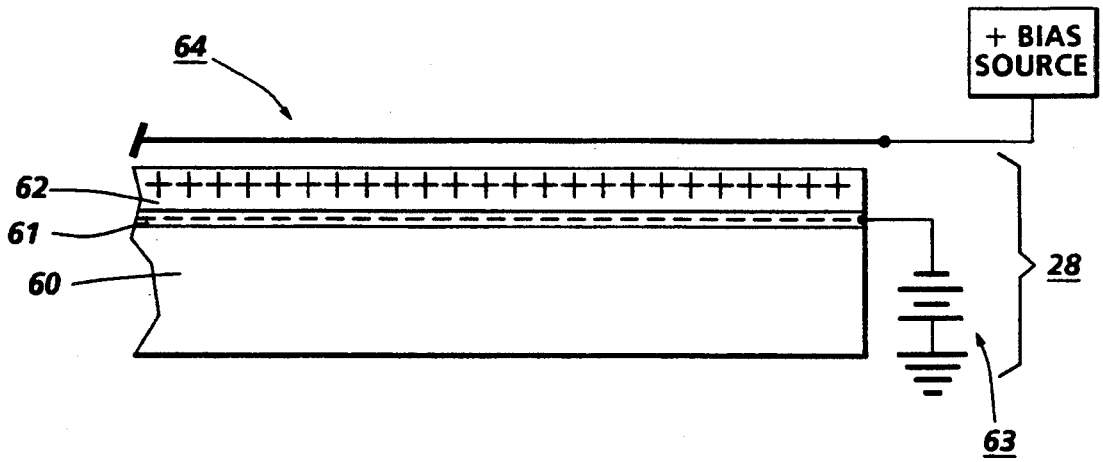
FIG. 2 is a functional schematic showing the effects of the pre-nip charging generated by the transfer apparatus of the present invention.
Figure 3:
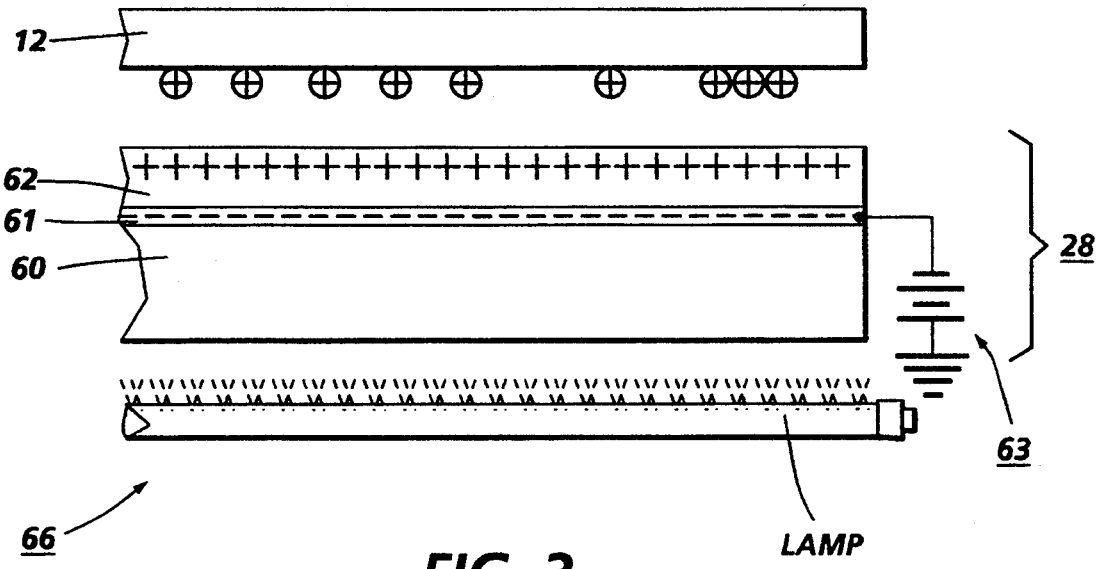
FIG. 3 is a functional schematic showing the charges in the nip region just prior to nip illumination as generated by the transfer apparatus of the present invention.
Figure 4:
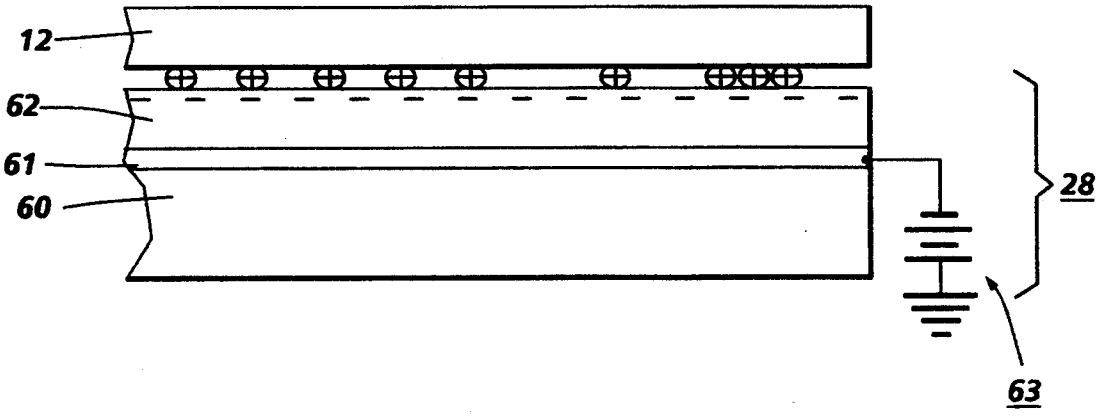
FIG. 4 is a functional schematic showing the final effects of the transfer apparatus of the present invention.

Turning now to the operation of the intermediate transfer belt of the present invention, reference is made to FIGS. 2–4 which show, among other things, a transverse section of the intermediate transfer belt 28. As previously discussed, the intermediate transfer belt 28 of the present invention includes the photoconductive layer 62 carried on a highly conductive backing substrate 60.

In FIG. 2, the pre-transfer nip region is illustrated, wherein a positive DC bias potential is applied to corona generating device 64 for generating a positively charged corona along the length thereof. The DC bias potential is selected to obtain sufficient corona current flow between the coronode and the photoconductive layer 62 without generating arcing therebetween. The corona current in the present example has a positive charge so as to deposit a positive charge on the exposed surface of the photoconductive layer 62. It is noted that the polarity of the charge and that the polarities shown and intimated, are described for illustration purposes only such that the present description applies equally to systems using different polarity schemes.

Continuing now with the description of the operation of the present invention, the positive charge deposited on the photoconductive layer 62 of intermediate belt 28 generates an equivalent applied potential having a polarity opposite to the applied potential on the conductive substrate 60. That is to say that, the potential due to the positive surface charge on the photoconductive intermediate 28 has the same effect as the applied potential on the conductive substrate 60 of the intermediate 28. Since the surface charge on the intermediate 28 is chosen to be opposite in polarity to that of the applied conductive intermediate substrate potential, the positive surface charge drives the effective applied potential for the system toward a positive polarity. Due to the positive surface charge applied to the intermediate, and assuming positively charged toner particles on the photoconductive drum 10, a weak or reverse field is formed between the toner particles and the intermediate transfer belt 28, so that toner particles will not efficiently transfer from the photoconductive drum 10 to the intermediate transfer belt 28.

Moving now to FIG. 3, there is shown the transfer nip, including illumination source 66, extending transverse to the intermediate transfer belt 28. Illumination source 66 can include a conventional lamp or other source for radiating electromagnetic radiation through the conductive layer 60 onto the photoconductive layer 62. The photoconductive layer 62 is responsive to light waves, and for this exemplary embodiment, is a positive charging photoconductor. Due to the properties of photoconductivity, the electrostatic field in the photoconductor will collapse to a low value when exposed to light. Thus, light waves incident upon the photoconductive layer 62 of the intermediate belt 28 by way of transparent conductive substrate 60 act to discharge the positive pre-charge on the surface of the photoconductive layer 62 to generate a high transfer field in the transfer nip. Consequently, the high transfer field in the transfer nip allows for effective and efficient transfer of toner particles onto the intermediate transfer belt 28. It will be appreciated that the light energy utilized herein may be either visible or invisible radiant energy for various applications, depending on the radiant energy sensitivity of the photoconductive material.

FIG. 4 illustrates the actual toner transfer process in the transfer nip. The conductive substrate 60 of the intermediate transfer belt 28 is biased by bias source 63 to a negative potential with respect to the zero reference potential of the substrate 12. The positive polarity surface charge previously deposited on the photoconductive intermediate has been discharged in the transfer nip due to field collapse in the photoconductor layer 62 caused by light exposure in the transfer nip. A high fraction of the negative charge that was on the photoconductive intermediate substrate prior to exposure to light is now on the top surface of the intermediate after the exposure to light. The substantial elimination of the positive surface charge-thus creates a high transfer field between the intermediate transfer belt 28 and the photoconductive surface 12 of the drum 10. These high transfer fields, in combination with pressure, as photoreceptive layer 12 contacts intermediate belt 28, cause toner transfer.

It is apparent from this description, that the transfer field strength is greater in the transfer nip area as a result of exposure to light, and that the fields in the pre-nip area are significantly weakened by the pre-charging thereat. Thus, the present invention utilizes a highly conductive backed photoconductor to generate the desired high transfer fields in the transfer nip without the undesirable high fields in the pre-transfer nip.

It will be appreciated that the the conductive substrate of drum 10 could have been biased positively with respect to a reference zero potential on the intermediate substrate 28 to provide the same condition as described above. It will also be appreciated that negative toner would require negative polarity pre-charging of the photoconductive intermediate 28 and positive polarity applied potential by the bias source 63.

In recapitulation, the electrophotographic printing apparatus of the present invention includes a toner transfer system having an intermediate transfer belt including a highly conductive transparent substrate with a photoconductive layer thereon. The intermediate transfer belt system includes a charging means for applying a pre-charge in a pre-transfer nip area to generate low or reversal fields in the pre-transfer zone. The intermediate transfer belt system also includes a light source so that the photoconductive surface of the intermediate transfer belt can be exposed to light in the transfer nip to discharge the pre-charge, causing an increase the transfer field in the transfer nip.

It is, therefore, evident that there has been provided, in accordance with the present invention, an electrophotographic printing apparatus that fully satisfies the aims and advantages of the invention as hereinabove set forth. While this invention has been described in conjunction with a preferred embodiment thereof, it is evident that many alternatives, modifications, and variations will be apparent to those skilled in the art. Accordingly, the present application for patent is intended to embrace all such alternatives, modifications and variations as are within the broad scope and spirit of the appended claims.

I claim:

1. An apparatus for transferring charged toner particles from an image support surface to a substrate, comprising:

an intermediate transfer member positioned to have at least a portion thereof adjacent said image support surface, defining a transfer nip, a pre-transfer zone, and a post-transfer zone;

biasing means, coupled to said intermediate transfer member, for providing an applied potential difference between said intermediate transfer member and the image support surface;

means, located adjacent said pre-transfer zone, for establishing a pre-charge on said intermediate transfer member in said pre-transfer zone; and means, located adjacent the transfer nip, for discharging the pre-charge on said intermediate transfer member.

2. The apparatus of claim 1, wherein said intermediate transfer member includes at least a conductive substrate having a photoconductive layer deposited thereon.

3. The apparatus of claim 1, wherein said means for establishing a pre-charge includes a corona generating device.

4. The apparatus of claim 2, wherein said means for discharging said intermediate transfer member includes an illumination source.

5. The apparatus of claim 2, wherein said means for discharging said intermediate transfer member includes a radiant energy source.

6. The apparatus of claim 2, wherein said conductive substrate is substantially transparent.

7. The apparatus of claim 1, further including means for transferring the toner particles from said intermediate transfer member to a copy substrate in image configuration.

8. An electrostatographic printing apparatus including a transfer assembly for transferring toner particles from an image support surface to a substrate, said transfer apparatus comprising:

an intermediate transfer member positioned to have at least a portion thereof adjacent said image support substrate defining a transfer nip, a pre-transfer zone, and a post-transfer zone;

biasing means, coupled to said intermediate transfer member, for providing an applied potential difference between said intermediate transfer member and the image support surface;

means, located adjacent said pre-transfer zone, for establishing a pre-charge on said intermediate transfer member in said pre-transfer zone; and means, located adjacent the transfer nip, for discharging the pre-charge on said intermediate transfer member.

9. The apparatus of claim 8, wherein said intermediate transfer member includes at least a conductive substrate having a photoconductive layer deposited thereon.

10. The apparatus of claim 8, wherein said means for establishing a pre-charge includes a corona generating device.

11. The apparatus of claim 9, wherein said means for discharging said intermediate transfer member includes an illumination source.

12. The apparatus of claim 9, wherein said means for discharging said intermediate transfer member includes a radiant energy source.

13. The apparatus of claim 9, wherein said conductive substrate is substantially transparent.

14. The apparatus of claim 8, further including means for transferring the toner particles from said intermediate transfer member to a copy substrate in image configuration.

15. An apparatus for transferring charged toner particles from an image support surface to a sheet, comprising an intermediate transfer member positioned to have at least a portion thereof adjacent the image support surface, said intermediate transfer member being adapted to receive toner particles from the image support surface and to transfer the toner particles therefrom to the sheet, wherein said intermediate transfer member includes:

a conductive substrate;

biasing means, coupled to said conductive substrate, for providing an applied potential difference between said intermediate transfer member and the image support surface; and a photoconductive layer deposited on said conductive substrate.

16. An apparatus according to claim 15, wherein said conductive substrate is substantially transparent.

17. An apparatus according to claim 15, further including means for transferring the toner particles from said intermediate transfer member to the sheet in image configuration.

* * * * *